US008694228B2

(12) United States Patent
Kitamura et al.

(10) Patent No.: US 8,694,228 B2
(45) Date of Patent: Apr. 8, 2014

(54) FUEL INJECTION CONTROL APPARATUS FOR INTERNAL COMBUSTION ENGINE

(75) Inventors: Natsuko Kitamura, Wako (JP); Jun Ishii, Wako (JP); Akitsugu Ikeda, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 179 days.

(21) Appl. No.: 13/358,516

(22) Filed: Jan. 26, 2012

(65) Prior Publication Data

US 2012/0192837 A1 Aug. 2, 2012

(30) Foreign Application Priority Data

Jan. 28, 2011 (JP) ..... 2011-017001

(51) Int. Cl.
*F02M 51/00* (2006.01)

(52) U.S. Cl.
USPC ..... 701/104; 123/479; 123/480; 123/490; 361/155; 361/156

(58) Field of Classification Search
USPC ..... 701/104; 123/479, 480–486, 490; 361/155, 156
See application file for complete search history.

(56) References Cited

U.S. PATENT DOCUMENTS

| | | | | |
|---|---|---|---|---|
| 5,717,562 | A * | 2/1998 | Antone et al. | 361/155 |
| 6,900,973 | B2 * | 5/2005 | Tojo et al. | 361/139 |
| 7,117,852 | B2 * | 10/2006 | Santero et al. | 123/490 |
| 7,527,040 | B2 * | 5/2009 | Couch | 123/490 |
| 7,546,830 | B2 * | 6/2009 | Nagase et al. | 123/490 |
| 7,621,259 | B2 * | 11/2009 | Mayuzumi | 123/490 |
| 7,823,860 | B2 * | 11/2010 | Ueda | 251/129.04 |
| 8,514,541 | B2 * | 8/2013 | Hatanaka et al. | 361/152 |

FOREIGN PATENT DOCUMENTS

JP 2006-336568 12/2006

* cited by examiner

*Primary Examiner* — Erick Solis
(74) *Attorney, Agent, or Firm* — Ditthavong Mori & Steiner, P.C.

(57) ABSTRACT

A fuel injection control for an internal combustion engine includes a coil, a first switch, a capacitor, a second switch, and a control circuit. The coil is to boost a voltage of a power supply source. The first switch is connected at one end to an output side of the coil and at the other end to a ground. The capacitor is connected to an electromagnetic fuel injection valve to store energy which has been stored in the coil. The second switch is connected at one end between the coil and the first switch and at the other end to an input side of the capacitor. The control circuit is connected to the first switch and the second switch. The control circuit is configured to perform synchronous rectifying control for switching the first switch and the second switch.

12 Claims, 6 Drawing Sheets

FUEL INJECTION CONTROL APPARATUS FOR INTERNAL COMBUSTION ENGINE

CROSS-REFERENCE TO RELATED APPLICATIONS

The present application claims priority under 35 U.S.C. §119 to Japanese Patent Application No. 2011-017001, filed Jan. 28, 2011, entitled "Fuel Injection Control Apparatus for Internal Combustion Engine." The contents of this application are incorporated herein by reference in their entirety.

BACKGROUND OF THE INVENTION

1. Field of the Invention

The present invention relates to a fuel injection control apparatus for an internal combustion engine.

2. Discussion of the Background

As this type of fuel injection control apparatus of the related art, a control apparatus disclosed in Japanese Unexamined Patent Application Publication No. 2006-336568 is known. This fuel injection control apparatus includes a coil, a switch, a diode, and a capacitor connected to a power source. The switch is constituted of a field-effect transistor (FET) and the drain thereof is connected to an output side of the coil. The source and the gate of the switch are connected to a ground and a control circuit, respectively. The anode of the diode is connected between the coil and the switch, and the cathode thereof is connected to the capacitor.

With this configuration, fuel is injected as follows. A drive signal is output from the control circuit so as to electrically connect the drain and the source of the switch (ON state). Then, a battery voltage is applied to the coil and energy is stored in the coil. This energy is supplied to the capacitor via the diode and is stored therein. Then, a boosted voltage stored in the capacitor is applied to a fuel injection valve to cause it to open, thereby injecting fuel from the fuel injection valve.

SUMMARY OF THE INVENTION

According to one aspect of the present invention, a fuel injection control apparatus is for an internal combustion engine in which a voltage is applied to an electromagnetic fuel injection valve to open the electromagnetic fuel injection valve, thereby injecting fuel from the electromagnetic fuel injection valve. The fuel injection control apparatus comprises a coil, a first switch, a capacitor, a second switch, and a control circuit. The coil is to boost a voltage of a power supply source. The first switch is connected at one end to an output side of the coil and at the other end to a ground. The capacitor is connected to the electromagnetic fuel injection valve to store energy which has been stored in the coil. The second switch is connected at one end between the coil and the first switch and at the other end to an input side of the capacitor. The control circuit is connected to the first switch and the second switch. The control circuit is configured to perform synchronous rectifying control for switching the first switch and the second switch so that the first switch is controlled to be ON and the second switch is controlled to be OFF so as to apply a voltage of the power supply source to the coil and to store energy in the coil, and so that the first switch is controlled to be OFF and the second switch is controlled to be ON so as to supply the energy stored in the coil to the capacitor and to store the energy in the capacitor, thereby boosting the voltage of the power supply source.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
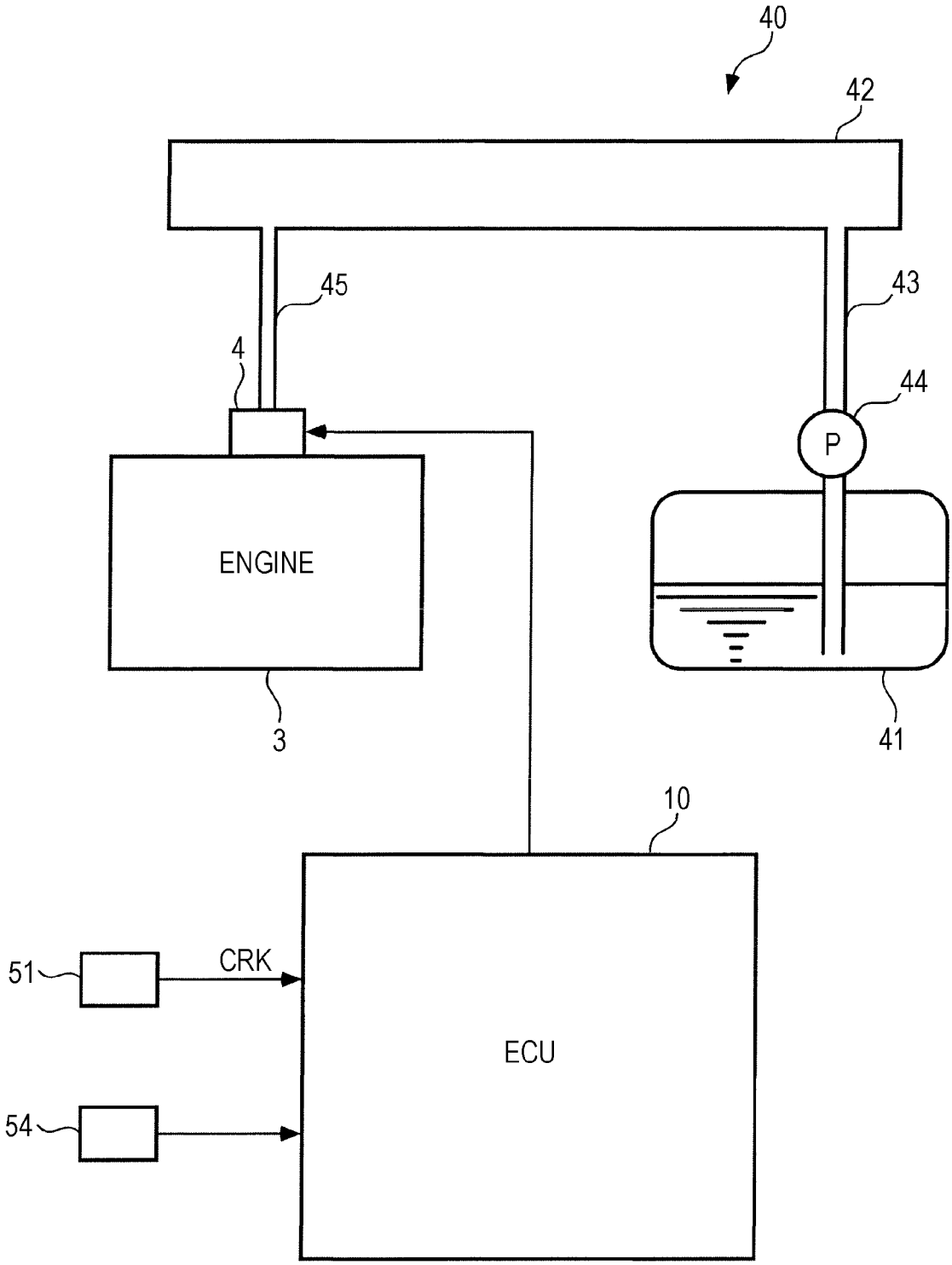
FIG. 1 schematically illustrates, together with an internal combustion engine, a fuel injection control apparatus according to embodiments of the present invention.

The embodiments will now be described with reference to the accompanying drawings, wherein like reference numerals designate corresponding or identical elements throughout the various drawings.

An internal combustion engine (hereinafter simply referred to as the "engine") 3 to which the fuel injection control apparatus of the embodiments of the present invention is applied is, as shown in FIG. 1, a direct-injection engine having, for example, four cylinders (not shown). Each cylinder is provided with a fuel injection valve (hereinafter referred to as the "injector") 4.

Figure 2A:
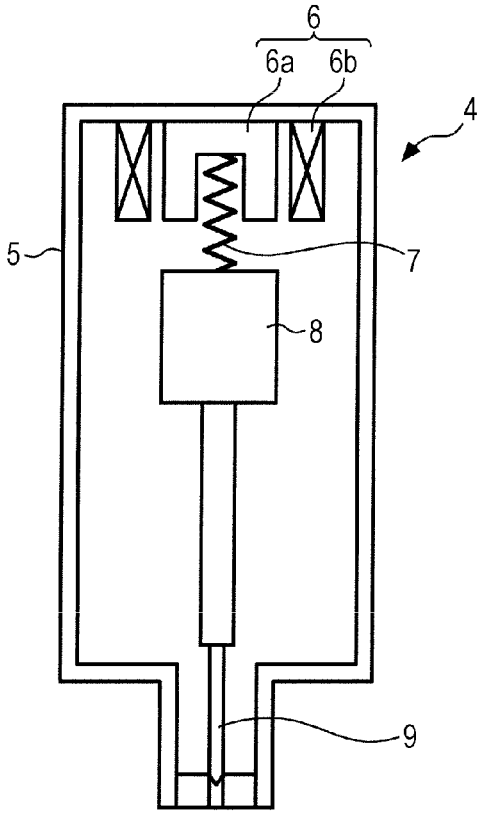
FIGS. 2A and 2B schematically illustrate an injector.
Figure 2B:
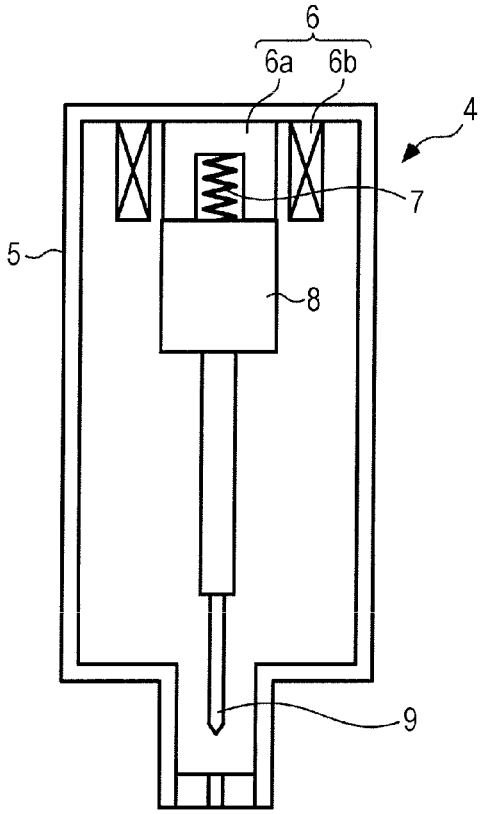

The injector 4 has a supply path (not shown), and is connected to a fuel supply apparatus 40 via this supply path. As shown in FIGS. 2A and 2B, the injector 4 is housed in a casing 5 and includes an electromagnet 6 which is fixed on the upper side of the housing 5, a spring 7, an armature 8 disposed below the electromagnet 6, and a valve element 9 which is integrally provided at the bottom portion of the armature 8.

The electromagnet 6 includes a yoke 6*a* and a coil 6*b* which is wound around the yoke 6*a*. A drive circuit 10, which is also referred to as an "engine control unit (ECU)" (FIG. 1) is connected to the coil 6*b*. The spring 7 is disposed between the yoke 6*a* and the armature 8 and urges the valve element 9 via the armature 8 in the direction in which the valve element 9 is closed.

Figure 3:
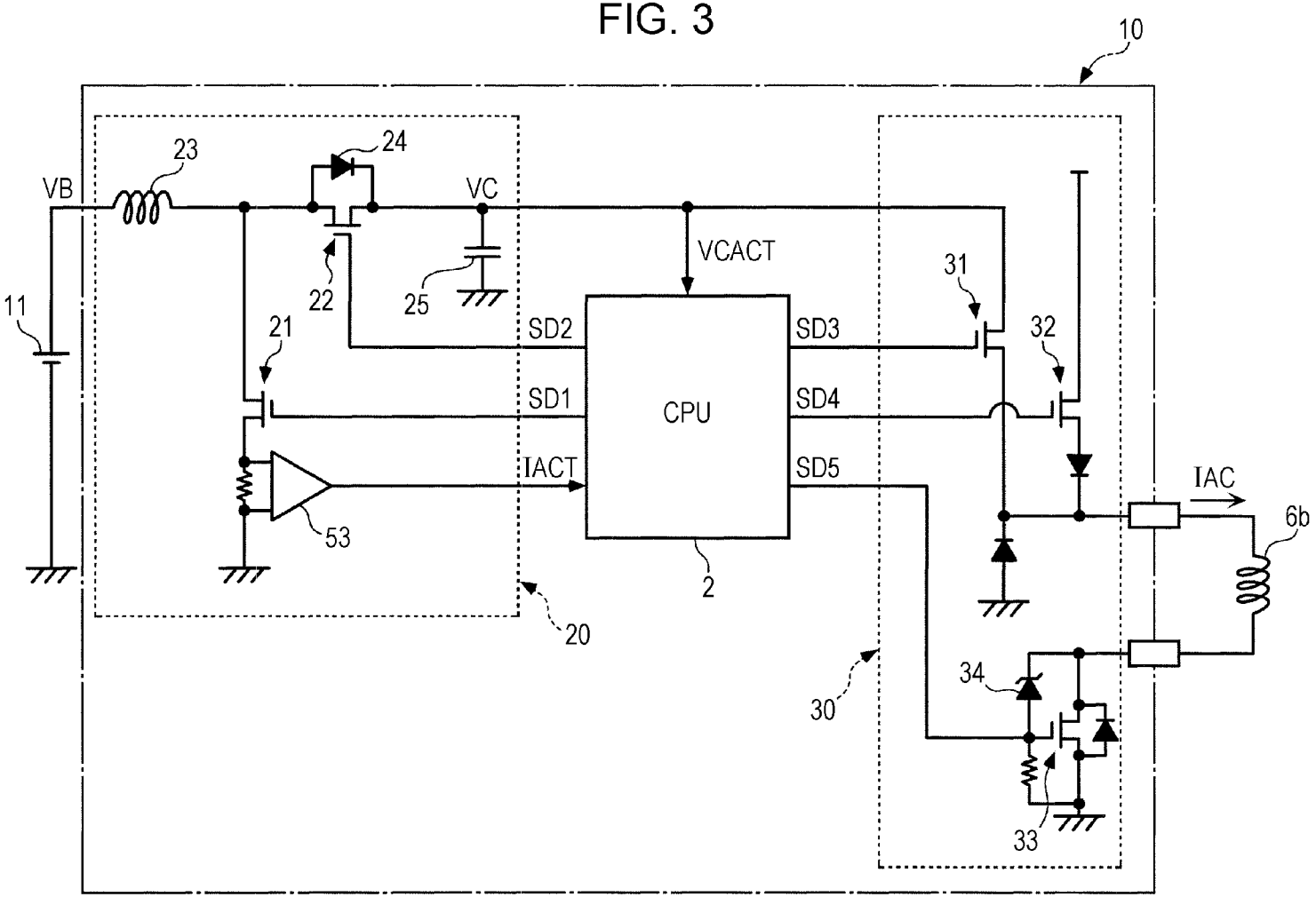
FIG. 3 is a circuit diagram of an engine control unit (ECU) according to a first embodiment of the present invention.

The ECU 10, which is used for driving the injector 4, includes, as shown in FIG. 3, a booster circuit 20 and an injector control circuit 30.

The booster circuit 20 includes a first switch 21, a second switch 22, a coil 23, a diode 24, and a capacitor 25. The first switch 21 is an N-channel FET and the drain thereof is connected to the output side of the coil 23 which is connected to a battery 11. The source and the gate of the first switch 21 are connected to a ground and a central processing unit (CPU) 2, respectively. Details of the CPU 2 will be given later. A first drive signal SD1 is input from the CPU 2 to the gate of the first switch 21 so as to electrically connect the drain and the source of the first switch 21 (ON state).

The second switch 22 is an N-channel FET and the drain thereof is connected between the first switch 21 and the coil 23. The source and the gate of the second switch 22 are connected to the input side of the capacitor 25 and the CPU 2, respectively. A second drive signal SD2 is input from the CPU 2 to the gate of the second switch 22 so as to electrically connect the drain and the source of the second switch 22 (ON state).

The diode 24 is provided in parallel with the second switch 22, and the anode of the diode 24 is connected to the drain of the second switch 22, and the cathode of the diode 24 is connected to the source of the second switch 22.

In the above-configured booster circuit 20, when the first switch 21 is turned ON so as to electrically connect the drain and the source, a voltage VB is applied from the battery 11 to the coil 23 so that energy is stored in the coil 23. When the source and the drain of the first switch 21 are electrically disconnected (OFF state), the energy stored in the coil 23 is supplied to the capacitor 25 via the diode 24 and is stored therein, thereby boosting the voltage. In this case, when the drain and the source of the second switch 22 are electrically connected, energy stored in the coil 23 is supplied to the capacitor 25 via the second switch 22 and is stored therein. Hereinafter, a control operation for supplying energy stored in the coil 23 to the capacitor 25 via the diode 24 is referred to as "diode rectifying control", and a control operation for supplying energy stored in the coil 23 to the capacitor 25 via the second switch 22 is referred to as "synchronous rectifying control".

The injector control circuit 30 includes third, fourth, and fifth switches 31, 32, and 33, respectively, which is each constituted of an N-channel FET, and a Zener diode 34. The drain, source, and gate of the third switch 31 are connected to the booster circuit 20, one end of the coil 6*b* of the electromagnet 6, and the CPU 2, respectively. When a third drive signal SD3 is input from the CPU 2 into the gate of the third switch 31, the drain and the source of the third switch 31 are electrically connected (ON state).

The drain, source, and gate of the fourth switch 32 are connected to the battery 11, one end of the coil 6*b* of the electromagnet 6, and the CPU 2, respectively. When a fourth drive signal SD4 is input from the CPU 2 into the gate of the fourth switch 32, the drain and the source of the fourth switch 32 are electrically connected (ON state).

The drain, source, and gate of the fifth switch 33 are connected to the other end of the coil 6*b* of the electromagnet 6, a ground, and the CPU 2, respectively. When a fifth drive signal SD5 is input from the CPU 2 into the gate of the fifth switch 33, the drain and the source of the fifth switch 33 are electrically connected (ON state).

The anode of the Zener diode 34 is connected to a ground, and the cathode thereof is connected to the other end of the coil 6*b*.

With this configuration, the injector control circuit 30 applies the voltage VB or the boosted voltage VC boosted in the booster circuit 20 to the coil 6*b* of the electromagnet 6 in accordance with the third through fifth drive signals SD3 through SD5 from the CPU 2, thereby supplying a drive current IAC. More specifically, the third switch 31 is turned OFF and the fourth and fifth switches 32 and 33 are turned ON so that the voltage VB is applied from the battery 11 to the coil 6*b*, thereby supplying the drive current IAC. Hereinafter, the drive current IAC which is supplied when the voltage VB is applied from the battery 11 is referred to as the holding current "IH".

On the other hand, the fourth switch 32 is turned OFF and the third and fifth switches 31 and 33 are turned ON so that the boosted voltage VC is applied from the booster circuit 20 to the coil 6*b*, thereby supplying the drive current IAC. Hereinafter, the drive current IAC which is supplied when the boosted voltage VC is applied from the booster circuit 20 is referred to as the overexcitation current IEX". When driving the injector 4, the overexcitation current IEX and the holding current IH are supplied to the coil 6*b* in this order, which will be discussed later.

With this configuration, when the third through fifth drive signals SD3 through SD5 are not output, the third through fifth switches 31 through 33 are in the OFF state. Accordingly, the valve element 9 is placed at the closed position (FIG. 2A) due to an urging force of the spring 7, thereby maintaining the injector 4 in the closed state.

In this state, the third and fifth drive signals SD3 and SD5 are output so as to supply the overexcitation current IEX to the coil 6*b* of the electromagnet 6. Then, the yoke 6*a* is excited and the armature 8 is attracted to the electromagnet 6 while resisting the urging force of the spring 7, thereby causing the injector 4 to open at a predetermined opening degree (FIG. 2B). Then, the output of the third drive signal SD3 is stopped so that the supply of the overexcitation current IEX finishes. At the same time, the fourth drive signal SD4 is output so that the supply of the holding current IH is started, thereby maintaining the injector 4 in the open state.

In this state, the output of the fourth and fifth drive signals SD4 and SD5 is stopped so that the supply of the holding current IH to the coil 6*b* finishes. Then, the valve element 9 is shifted to the closed state due to the urging force of the spring 7, thereby closing the injector 4.

The fuel supply apparatus 40 includes, as shown in FIG. 1, a fuel tank 41 for storing fuel therein, a fuel storage chamber 42 for storing high-pressure fuel therein, and a fuel supply path 43 for connecting the fuel tank 41 and the fuel storage chamber 42. The fuel storage chamber 42 is connected to the above-described supply path of the injector 4 via a fuel injection path 45. A pump 44, which is provided in the fuel supply path 43, increases the pressure of the fuel within the fuel tank 41 to a predetermined pressure and pumps the fuel to the fuel storage chamber 42.

A crankshaft of the engine 3 is provided with a crank angle sensor 51. The crank angle sensor 51 inputs a CRK signal, which is a pulse signal, into the ECU 10 in accordance with the rotation of the crankshaft. The ECU 10 calculates the rotation speed of the engine 3 (hereinafter referred to as the "engine speed") NE on the basis of the CRK signal.

A voltmeter (not shown) and an ammeter 53 are connected to the CPU 2. The voltmeter detects the actual boosted voltage (hereinafter referred to as the "actual boosted voltage") VCACT output from the coil 23 and inputs a detection signal representing the actual boosted voltage VCACT into the CPU 2. The ammeter 53 detects the current actually flowing through the capacitor 25 (hereinafter referred to as the "actual current") IACT and inputs a detection signal representing the actual current IACT into the CPU 2.

An ignition switch 54 inputs a signal representing the ON/OFF state of the ignition switch 54 into the ECU 10.

The CPU 2 is constituted of a microcomputer, and is connected to a random access memory (RAM), a read only memory (ROM), an input/output (I/O) interface (none of which are shown), etc. The CPU 2 determines the operating state of the engine 3 from the detection signals of sensors, such as the crank angle sensor 51 and the ammeter 53, and also controls the injector control circuit 30 in accordance with the determined operating state of the engine 3 so as to control fuel injection of the injector 4. The CPU 2 also performs boosting control processing for boosting the voltage VB.

Figure 4:
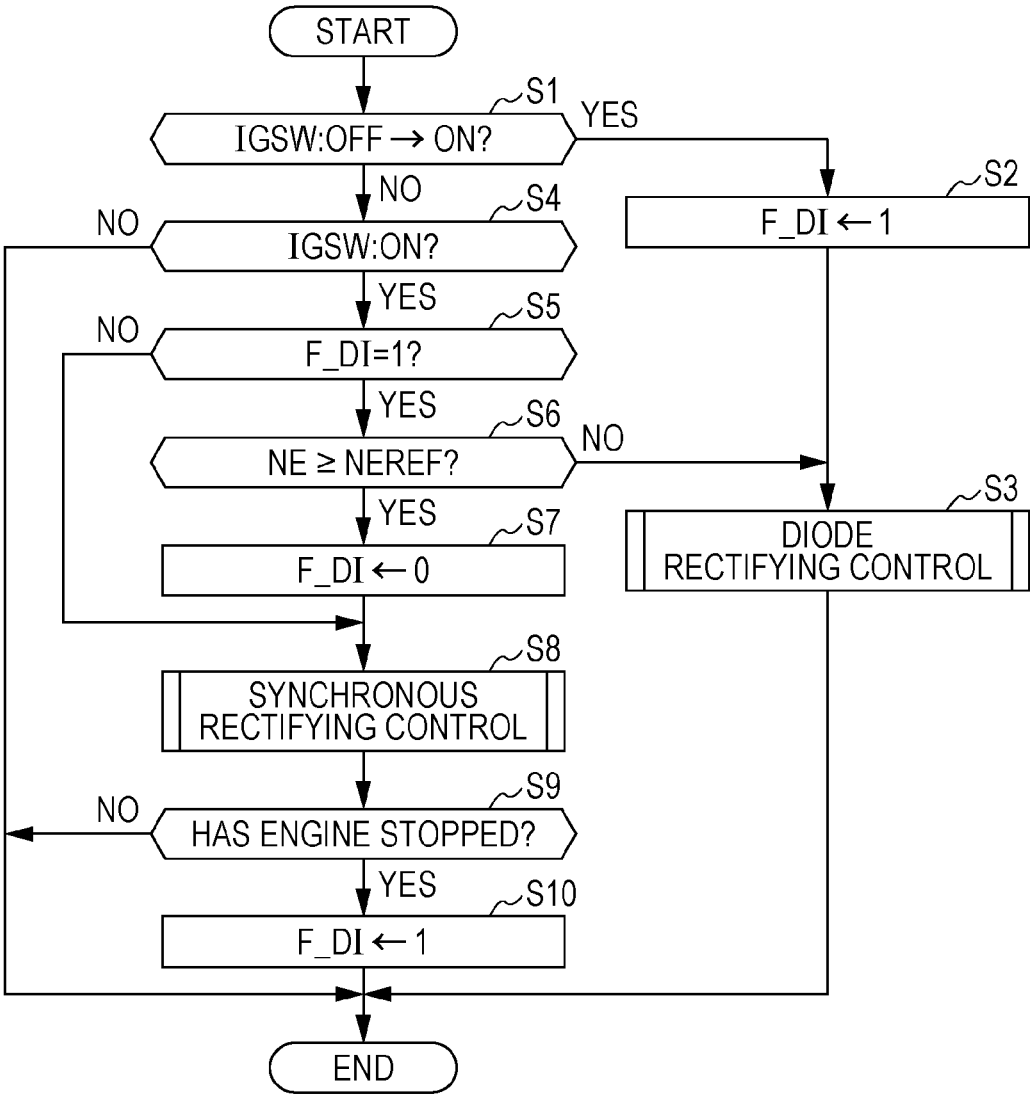
FIG. 4 is a flowchart illustrating boosting control processing.

FIG. 4 is a flowchart illustrating the above-described boosting control processing. This processing is performed at regular intervals. In step S1 (shown as "S1" in FIG. 4, and the other step numbers being expressed in the same way), it is determined whether the ignition switch (IGSW) 54 has changed from OFF to ON between the previous operation and the current operation. If the result of step S1 is YES, it means that the engine 3 has just started, and thus, diode rectifying control is performed. The flow then proceeds to step S2 in which the diode rectifying flag F_DI is set to be "1". Then, in step S3, diode rectifying control is performed. The processing is then completed.

If the result of step S1 is NO, it does not mean that the engine 3 has just started. The process then proceeds to step S4 to determine whether the ignition switch 54 is ON. If the result of step S4 is NO, the processing is completed.

If the result of step S4 is YES, the process proceeds to step S5 to determine whether the diode rectifying flag F_DI is "1". If the result of step S5 is YES, the process proceeds to step S6 to determine whether the engine speed NE is equal to or greater than a predetermined speed NERER. If the result of step S6 is NO, the process proceeds to step S3 in which diode rectifying control is continuously performed. The processing is then completed.

If the result of step S6 is YES, it means that the engine speed NE has reached the predetermined speed NEREF after the engine 3 started. Accordingly, the process proceeds to step S7 in which the diode rectifying flag F_DI is set to be "0" to complete diode rectifying control. The process then proceeds to step S8 in which synchronous rectifying control is started. After shifting to synchronous rectifying control, the process proceeds to step S9 to determine whether the engine 3 has stopped. If the result of step S9 is NO, the processing is completed. If the result of step S9 is YES, the process proceeds to step S10 in which the diode rectifying flag F_DI is set to be "1". The processing is then completed. Because of the execution of step S10, even if the engine 3 has stopped while the ignition switch 54 is ON, diode rectifying control can be reliably started instead of synchronous rectifying control after the engine 3 has restarted.

If the result of step S5 is NO after the execution of step S7, the process directly proceeds to step S8 in which synchronous rectifying control is continuously performed.

As described above, after the engine 3 has started, while the engine speed NE is smaller than the predetermined engine speed NEREF, diode rectifying control is performed, and when the engine speed NE has reached the predetermined engine speed NEREF, synchronous rectifying control is started and performed until the engine 3 stops.

Figure 5:
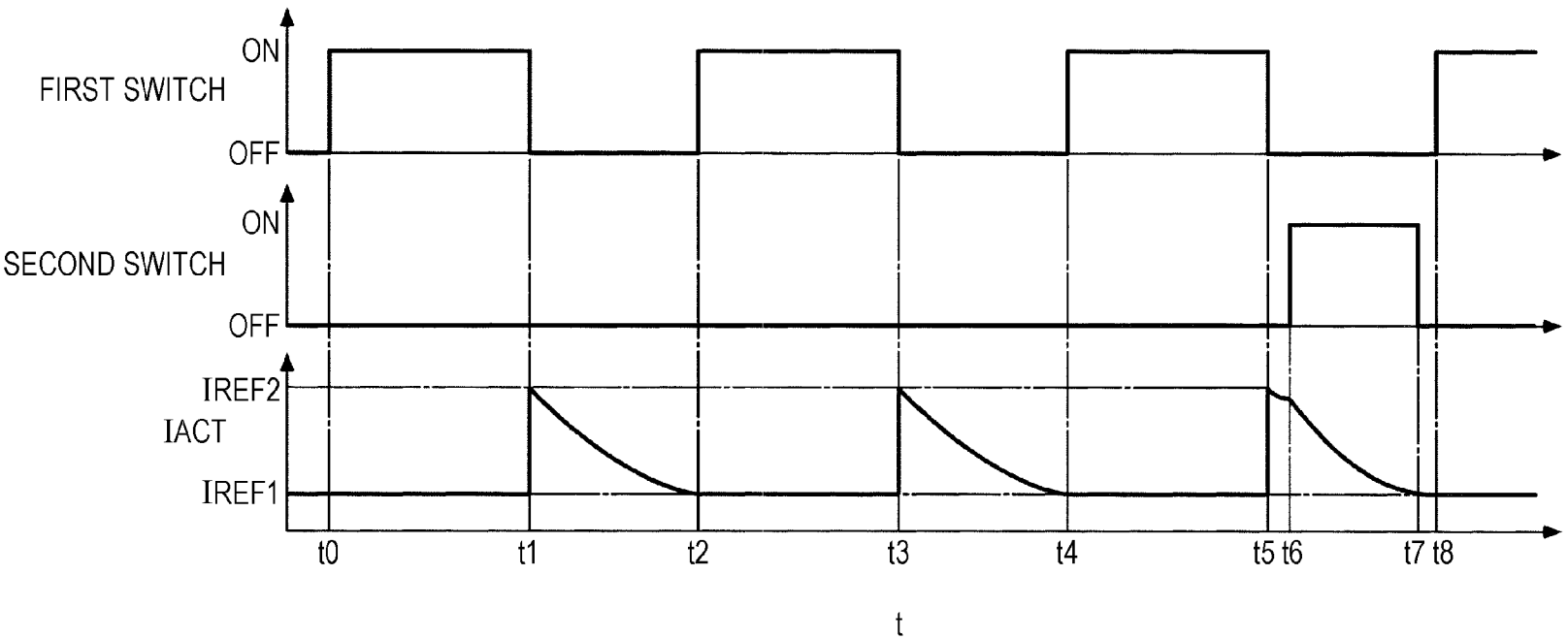
FIG. 5 is a timing chart illustrating an example of an operation when the above-described boosting control processing is performed.

FIG. 5 is a timing chart illustrating an example of an operation when the above-described boosting control is performed. Immediately after the ignition switch 54 has been turned ON to start the engine 3, both the first and second switches 21 and 22 are controlled to be OFF, and also, the actual current IACT is equal to or smaller than a first predetermined value IREF1. The boosting flag F_PRS is reset to "0".

In this state, diode rectifying control is performed so as to turn ON the first switch 21 at timing t0. Then, the voltage VB is applied to the coil 23 so that energy is stored in the coil 23. Accordingly, the actual current IACT increases, and when it reaches a second predetermined value IREF2 at time t1, the first switch 21 is turned OFF, and the second switch 22 is maintained in the OFF state. Then, energy stored in the coil 23 is supplied to the capacitor 25 via the diode 24 and is stored therein.

Because of the storage of energy in the capacitor 25, the actual current IACT gradually decreases, and when it becomes lower than the first predetermined value IREF1 at time t2, the first switch 21 is turned ON again so as to store energy in the coil 23. Thereafter, when the actual current IACT exceeds the second predetermined value IREF2 at time t3, the first switch 21 is turned OFF so that energy stored in the coil 23 is supplied to the capacitor 25 via the diode 24 and is stored therein. In this manner, after the engine 3 has started, diode rectifying control is performed in which a storage operation for storing energy in the coil 23 by turning ON the first switch 21 and by allowing the second switch 22 to remain OFF, and a boosting operation for supplying energy to the capacitor 25 via the diode 24 and storing it therein by turning OFF the first switch 21 to boost the voltage are alternately repeated.

Thereafter, when the engine speed NE has reached the predetermined engine speed NEREF in step S6 of FIG. 4, synchronous rectifying control is performed. More specifically, when the actual current IACT becomes lower than the first predetermined voltage IREF1 at time t4, the first switch 21 is turned ON while the second switch 22 remains OFF, thereby applying the voltage VB to the coil 23. Then, when the actual current IACT reaches the second predetermined value IREF2 at time t5, the first switch 21 is turned OFF so that energy stored in the coil 23 is supplied to the capacitor 25 via the diode 24 and is stored therein.

Then, after the lapse of a predetermined time from time t5, at time t6, the second switch 22 is turned ON so that energy in the coil 23 is supplied to the capacitor 25 via the second switch 22 and is stored therein. When the actual current IACT becomes lower than the first predetermined value IREF1 at time t7 because of the storage of energy in the capacitor 25, the second switch 22 is turned OFF. Then, after the lapse of a predetermined time from t7, at time t8, the first switch 21 is turned ON so as to store energy in the coil 23. Thereafter, the operation from time t5 to time t8 is similarly repeated, whereby energy stored in the coil 23 is supplied to and is stored in the capacitor 25. The above-described operation from t4 to t8 is repeatedly performed. In this manner, when the engine speed NE has reached the predetermined engine speed NEREF after the engine 3 started, synchronous rectifying control is performed in which a storage operation for storing energy in the coil 23 by turning ON the first switch 21 and by allowing the second switch 22 to remain OFF, and a boosting operation for supplying energy to the capacitor 25 via the second switch 22 and storing it therein by turning OFF the first switch 21 and by turning ON the second switch 22 to boost the voltage are alternately repeated.

As described above, in this embodiment, after the engine 3 has started and before the operating state of the engine 3 becomes stable, diode rectifying control is performed, and the second switch 22 remains OFF. It is thus possible to supply energy stored in the coil 23 to the capacitor 25 via the diode 24 while reliably preventing a current from flowing back from the capacitor 25 to the second switch 22.

Then, after the operating state of the engine 3 becomes stable, synchronous rectifying control is performed. Accordingly, power consumption can be suppressed. As a result, it is possible to reduce the amount of heat required for boosting a voltage and also to reduce the size and the manufacturing cost of a heat radiating structure including a heat sink and a heat transfer path.

Additionally, the diode 24 is disposed in parallel with the second switch 22. Accordingly, when synchronous rectifying control is performed, switching of the first and second switches 21 and 22 can be performed with a predetermined time lag. This can reliably prevent a current from flowing back from the capacitor 25 to the second switch 22.

Figure 6:
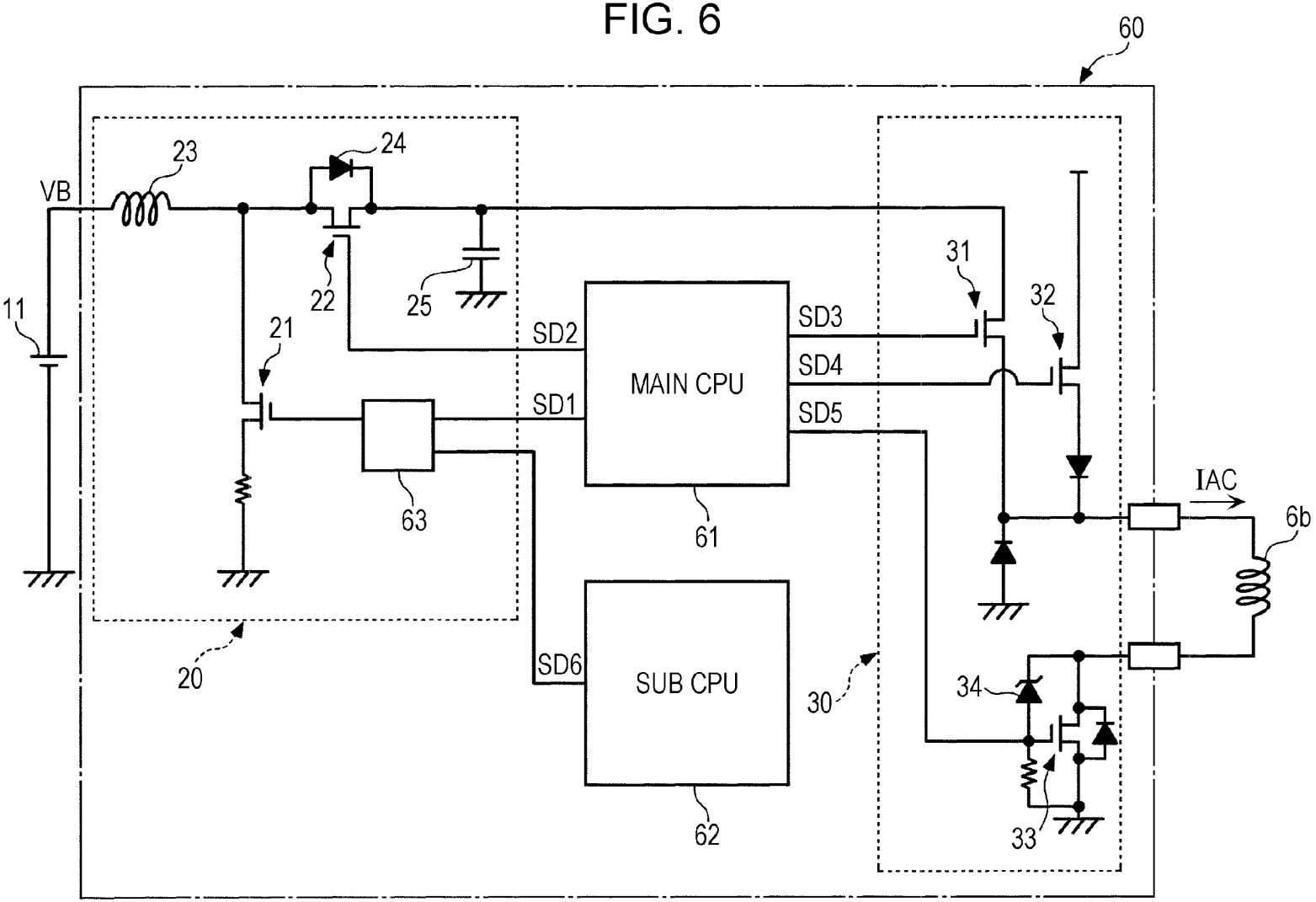
FIG. 6 is a circuit diagram of an ECU according to a second embodiment of the present invention.

FIG. 6 illustrates a drive circuit (ECU) 60 according to a second embodiment of the present invention. In the following description, elements configured similarly to those of the first embodiment are designated by like reference numerals, and a detailed explanation thereof will thus be omitted. The drive circuit 60 includes a booster circuit 20, an injector control circuit 30, a main CPU 61, a sub CPU 62, and a switching circuit 63.

The main CPU 61 serves to control the injector 4 and the first and second switches 21 and 22, particularly serves to control the first switch 21 when performing synchronous rectifying control. The main CPU 61 is configured similarly to the CPU 2 of the first embodiment, and is connected to the gate of the first switch 21 via the switching circuit 63.

The sub CPU 62 is a dedicated CPU specially used for controlling the first switch 21 only when diode rectifying control is performed, and is connected to the gate of the first switch 21 via the switching circuit 63.

The switching circuit 63 serves to selectively connect the gate of the first switch 21 to the main CPU 61 or the sub CPU 62. More specifically, when diode rectifying control is performed, the switching circuit 63 connects the gate of the first switch 21 to the sub CPU 62, and when synchronous rectifying control is performed, the switching circuit 63 connects the gate of the first switch 21 to the main CPU 61.

With this configuration, while diode rectifying control is being performed, the ON/OFF operation of the first switch 21 is controlled by a sixth drive signal SD6 supplied from the sub CPU 62, and while synchronous rectifying control is being performed, the ON/OFF operation of the first switch 21 is controlled by a first drive signal SD1 supplied from the main CPU 61.

As described above, according to the second embodiment, while diode rectifying control is being performed, instead of the main CPU 61, the sub CPU 62, which is a dedicated CPU, is used specially for controlling the first switch 21. Accordingly, the time necessary to start the sub CPU 62 when the engine 3 is started can be decreased. As a result, it is possible to start to control the first switch 21 promptly after the engine 3 has started, thereby speedily performing a boosting operation by using the first switch 21.

The present invention is not restricted to the above-described embodiments, and may be carried out in various modes. For example, in the above-described embodiments, both diode rectifying control and synchronous rectifying control are performed. However, only synchronous rectifying control may be performed.

In the second embodiment, the target element that the sub CPU 62 performs control is restricted to the first switch 21. However, the sub CPU 62 may control another element on the condition that the number of elements controlled by the sub CPU 62 is smaller than that by the main CPU 61.

In the above-described embodiments, the present invention is applied to an engine installed in a vehicle. However, the present invention is not restricted to this, and may be applied to an engine other than for a vehicle, for example, for a ship propulsion system, such as an outboard motor including a vertical crankshaft. Additionally, details of the configuration may be modified appropriately within the scope of the invention.

According to the embodiment of the invention, there is provided a fuel injection control apparatus for an internal combustion engine, in which a voltage is applied to an electromagnetic fuel injection valve to open the electromagnetic fuel injection valve, thereby injecting fuel from the electromagnetic fuel injection valve. The fuel injection control apparatus includes: a coil that is used for boosting a voltage of a power supply source (battery 11); a first switch that is connected at one end to an output side of the coil and at the other end to a ground; a capacitor that is connected to the electromagnetic fuel injection valve and that stores energy which has been stored in the coil; a second switch that is connected at one end between the coil and the first switch and at the other end to an input side of the capacitor; and a control circuit (CPU 2) that is connected to the first switch and the second switch and that performs synchronous rectifying control for switching the first switch and the second switch so that the first switch is controlled to be ON and the second switch is controlled to be OFF so as to apply a voltage of the power supply source to the coil and to store energy in the coil, and then, the first switch is controlled to be OFF and the second switch is controlled to be ON so as to supply the energy stored in the coil to the capacitor and to store the energy in the capacitor, thereby boosting the voltage.

In this fuel injection control apparatus, the control circuit controls the ON/OFF state of the first switch and the second switch, thereby performing synchronous rectifying control. More specifically, the first switch is controlled to be ON and the second switch is controlled to be OFF so that a voltage of the power supply source is applied to the coil and is stored therein. Then, the first switch is controlled to be OFF and the second switch is controlled to be ON so that energy stored in the coil is supplied to the capacitor and is stored therein, thereby boosting the voltage. Then, the boosted voltage is applied to the fuel injection valve so as to cause it to open, thereby injecting fuel from the fuel injection valve.

The amount of heat emitted in a switch is smaller than that in a diode. In synchronous rectifying control, instead of the diode, the second switch is used to supply energy to the capacitor. Accordingly, power consumption is suppressed. As a result, the amount of heat required for boosting a voltage can be reduced, and also, the size of a heat radiating structure including a heat sink and a heat transfer path can be decreased, and the manufacturing cost thereof can accordingly be reduced.

The above-described fuel injection control apparatus may further include: a diode whose anode is connected to an input side of the second switch and whose cathode is connected to an output side of the second switch; and a rotation speed detector (ECU 10) that detects a rotation speed (engine speed NE) of the internal combustion engine. The control circuit may be driven by the voltage of the power supply source and may perform a power OFF control operation so that the second switch is maintained to be OFF for a period from when the internal combustion engine has started until when the rotation speed of the internal combustion engine detected by the rotation speed detector reaches a predetermined rotation speed.

Immediately after an internal combustion engine has started, the voltage of a power supply source is likely to be unstable. Accordingly, the operation of the control circuit driven by that voltage is also likely to be unstable. Thus, both the first switch and the second switch may simultaneously be turned ON, in which case, a current flows back from the capacitor to the second switch, which may damage the control circuit. According to the embodiment of the present invention, after the internal combustion engine has started, while the detected rotation speed of the internal combustion engine is smaller than a predetermined rotation speed, the power OFF control operation is performed so that the second switch is maintained in the OFF state, thereby reliably preventing a current from flowing back from the capacitor to the second switch.

The diode is connected to the second switch. Accordingly, energy stored in the coil can be supplied to the capacitor via the diode while preventing a current from flowing back from the capacitor to the second switch.

In the above-described fuel injection control apparatus, the control circuit may include a first control circuit (main CPU 61) that controls the electromagnetic fuel injection valve and the first and second switches, and a second control circuit (sub CPU 62) that controls the first switch, in place of the first control circuit, while the power OFF control operation is being performed.

With this configuration, during the normal operation, the first control circuit is used for controlling the fuel injection valve and the first and second switches. During the power OFF control operation, instead of the first control circuit, the second control circuit is used for controlling the first switch. As the number of elements controlled by the control circuit is larger, the time necessary to start the control circuit when the internal combustion engine is started is longer, since it takes time to initialize the elements. According to the embodiment of the present invention, during the power OFF control operation, the second control circuit serves as a dedicated control circuit specially used for controlling the first switch. Accordingly, the time necessary to start the second control circuit is decreased, and as a result, it is possible to start to control the first switch promptly after the internal combustion engine has started, thereby speedily performing a boosting operation by using the first switch.

In the above-described fuel injection control apparatus, the control circuit may be a single circuit.

With this configuration, the cost can be reduced compared with a case where the control circuit includes a plurality of circuits.

Obviously, numerous modifications and variations of the present invention are possible in light of the above teachings. It is therefore to be understood that within the scope of the appended claims, the invention may be practiced otherwise than as specifically described herein.

What is claimed is:

1. A fuel injection control apparatus for an internal combustion engine in which a voltage is applied to an electromagnetic fuel injection valve to open the electromagnetic fuel injection valve, thereby injecting fuel from the electromagnetic fuel injection valve, the fuel injection control apparatus comprising:

a coil to boost a voltage of a power supply source;

a first switch connected at one end to an output side of the coil and at the other end to a ground;

a capacitor connected to the electromagnetic fuel injection valve to store energy which has been stored in the coil;

a second switch connected at one end between the coil and the first switch and at the other end to an input side of the capacitor; and a control circuit connected to the first switch and the second switch, the control circuit being configured to perform synchronous rectifying control for switching the first switch and the second switch so that the first switch is controlled to be ON and the second switch is controlled to be OFF so as to apply a voltage of the power supply source to the coil and to store energy in the coil, and so that the first switch is controlled to be OFF and the second switch is controlled to be ON so as to supply the energy stored in the coil via the second switch to the capacitor and to store the energy in the capacitor, thereby boosting the voltage of the power supply source, the control circuit being configured to perform the synchronous rectifying control by applying, to the electromagnetic fuel injection valve, a voltage which is boosted by repeatedly performing boosting operation in which the first switch and the second switch are switched.

2. The fuel injection control apparatus for an internal combustion engine according to claim 1, further comprising:

a diode including anode and cathode, the anode being connected to an input side of the second switch, the cathode being connected to an output side of the second switch; and a rotation speed detector configured to detect a rotation speed of the internal combustion engine, wherein the control circuit is driven by the voltage of the power supply source and is configured to perform a power OFF control operation so that the second switch is maintained to be OFF for a period from when the internal combustion engine has started until when the rotation speed of the internal combustion engine detected by the rotation speed detector reaches a predetermined rotation speed.

3. The fuel injection control apparatus for an internal combustion engine according to claim 2, wherein the control circuit includes a first control circuit an a second control circuit, the first control circuit being configured to control the electromagnetic fuel injection valve and the first and second switches, the second control circuit being configured to control the first switch, in place of the first control circuit, while the power OFF control operation is being performed.

4. The fuel injection control apparatus for an internal combustion engine according to claim 1, wherein the control circuit is a single circuit.

5. The fuel injection control apparatus for an internal combustion engine according to claim 2, further comprising:

an ammeter configured to detect an actual boosted voltage output from the coil, wherein the control circuit controls the first switch and the second switch based on the actual boosted voltage detected by the ammeter.

6. The fuel injection control apparatus for an internal combustion engine according to claim 5, wherein the control circuit controls the first switch to be ON when the actual boosted voltage detected by the ammeter is lower than a first predetermined voltage, wherein the control circuit controls the first switch to be OFF when the actual boosted voltage detected by the ammeter reaches a second predetermined voltage, the second predetermined voltage being higher than the first predetermined voltage.

7. The fuel injection control apparatus for an internal combustion engine according to claim 6, wherein, while the rotation speed of the internal combustion engine detected by the rotation speed detector reaches the predetermined rotation speed, the control circuit controls the second switch to be ON after a lapse of a predetermined time from when the control circuit switches the first switch to OFF, and the control circuit controls the second switch to be OFF when the actual boosted voltage detected by the ammeter is lower than the first predetermined voltage.

8. The fuel injection control apparatus for an internal combustion engine according to claim 1, wherein the control circuit is configured to set a time interval between ON state of the first switch and ON state of the second switch such that the ON state of the first switch and the ON state of the second switch do not overlap with each other in the synchronous rectifying control.

9. The fuel injection control apparatus for an internal combustion engine according to claim 2, further comprising:

a diode including an anode connected to an input side of the second switch, and a cathode connected to an output side of the second switch, wherein the control circuit is configured to perform diode rectifying control by supplying and storing the energy stored in the coil via the diode to the capacitor by switching only the first switch for performing diode rectifying control, and the control circuit is configured to select one of the synchronous rectifying control and the diode rectifying control in accordance with an operation state of the internal combustion engine.

10. The fuel injection control apparatus for an internal combustion engine according to claim 9, wherein the control circuit includes a first control circuit configured to control the electromagnetic fuel injection valve and configured to perform the synchronous rectifying control, and a second control circuit configured to perform the diode rectifying control when the internal combustion engine starts.

11. The fuel injection control apparatus for an internal combustion engine according to claim 1, further comprising:

a diode including an anode connected to an input side of the second switch, and a cathode connected to an output side of the second switch, wherein the control circuit is configured to perform diode rectifying control by supplying and storing the energy stored in the coil via the diode to the capacitor by switching only the first switch for performing diode rectifying control, and the control circuit is configured to select one of the synchronous rectifying control and the diode rectifying control in accordance with an operation state of the internal combustion engine.

12. The fuel injection control apparatus for an internal combustion engine according to claim 11, wherein the control circuit includes a first control circuit configured to control the electromagnetic fuel injection valve and configured to perform the synchronous rectifying control, and a second control circuit configured to perform the diode rectifying control when the internal combustion engine starts.

* * * * *